US007326306B2

(12) United States Patent
Ishii et al.

(10) Patent No.: US 7,326,306 B2
(45) Date of Patent: Feb. 5, 2008

(54) METHOD FOR PRODUCING NITRIDING STEEL

(75) Inventors: Kazuo Ishii, Wako (JP); Yoshihiro Odagiri, Wako (JP); Takeshi Munemura, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/489,869

(22) PCT Filed: Jul. 22, 2002

(86) PCT No.: PCT/JP02/07395

§ 371 (c)(1),
(2), (4) Date: Mar. 24, 2004

(87) PCT Pub. No.: WO03/033757

PCT Pub. Date: Apr. 24, 2003

(65) Prior Publication Data

US 2004/0238073 A1 Dec. 2, 2004

(30) Foreign Application Priority Data

Oct. 16, 2001 (JP) ..... 2001-318602

(51) Int. Cl.
*C23C 8/26* (2006.01)

(52) U.S. Cl. ..... 148/217; 148/230

(58) Field of Classification Search ..... 148/230
See application file for complete search history.

(56) References Cited

U.S. PATENT DOCUMENTS

| | | | | |
|---|---|---|---|---|
| 2,343,418 | A | 3/1944 | Lampton et al. | |
| 3,497,365 | A * | 2/1970 | Wagner et al. | 106/8 |
| 4,292,094 | A | 9/1981 | Kunst et al. | |
| 4,702,779 | A | 10/1987 | Madsac et al. | |
| 5,013,371 | A * | 5/1991 | Tahara et al. | 148/231 |
| 6,431,761 | B1 | 8/2002 | Yamaguchi et al. | |

FOREIGN PATENT DOCUMENTS

DE 119822 5/1976

(Continued)

OTHER PUBLICATIONS

Davis et al, Metals Handbook, 1994, ASM International, vol. 1, pp. 793-800.*

(Continued)

*Primary Examiner*—Roy King
*Assistant Examiner*—Jessee Roe
(74) *Attorney, Agent, or Firm*—Arent Fox LLP

(57) ABSTRACT

In the present invention, after a nitriding process is performed on a steel, a passivating process in which the steel is heated under an atmosphere containing oxygen is performed. The heating condition of the passivating process is within a range surrounded by (100° C., 120 min), (100° C., 10 min), (125° C., 5 min), (190° C., 5 min), (200° C., 10 min), (200° C., 20 min), (190° C., 30 min), (190° C., 40 min), (180° C., 60 min), and (180° C., 120 min) on coordinate axes of temperature and time. In the process for production of the nitrided steel, uniform passivated layer can be easily formed, and fatigue strength is improved as pitting corrosion resistance is improved.

5 Claims, 9 Drawing Sheets

FOREIGN PATENT DOCUMENTS

| | | | | |
|---|---|---|---|---|
| EP | 0 217 420 | A2 | | 4/1987 |
| EP | 0299625 | | * | 7/1987 |
| EP | 0 299 625 | A2 | | 1/1989 |
| EP | 0931849 | | | 7/1999 |
| JP | 48-103432 | | | 12/1973 |
| JP | 62-235463 | A | * | 10/1987 |
| JP | 64-079362 | | | 3/1989 |
| JP | 01-142022 | | | 6/1989 |
| JP | 02-190416 | | | 7/1990 |
| JP | 05-057400 | | * | 3/1994 |
| JP | 06-184728 | | | 7/1994 |
| JP | 06-306653 | | | 11/1994 |
| JP | 11-279843 | | | 10/1999 |
| JP | 2000-169941 | | | 6/2000 |
| JP | 2000-219956 | | | 8/2000 |
| JP | 2001-026857 | | | 1/2001 |
| SU | 1477752 | | | 5/1989 |

OTHER PUBLICATIONS

Examples of Metallic Corrosion and Various Kinds of Anticorrosion, dated Apr. 26, 1996, Publisher: Tadasi Nakajima.

Handbook of Corrosion and Anticorrosion, dated Feb. 29, 2000, Publisher: Nobuo Suzuki.

* cited by examiner

[Anodic polarization curve]

METHOD FOR PRODUCING NITRIDING STEEL

BACKGROUND OF THE INVENTION

1. Technical Field

The present invention relates to a process for production of nitrided steel having high pitting corrosion resistance and superior fatigue strength.

2. Background Art

In recent years, CTV (Continuously Variable Transmission) is widely used as a stepless transmission for automobiles. The CTV is formed by annularly connecting plural pushing blocks with a metallic hoop. High fatigue strength is required for steel used in such hoops and springs because bending force is applied repeatedly. As a technique to improve fatigue strength of various kinds of steel, a nitriding method is known as is disclosed in, for example, Japanese Unexamined Patent Application Publications Nos. 1-142022, 2000-219956, or 2001-26857. However, since the surface is activated during the nitriding process, part of the surface is corroded and pitting corrosion is formed due to the presence of halogens, and corrosion resistance may be deteriorated. Such pitting corrosion often grows in a depth direction, and it is difficult to discover by visual inspection. In particular, in the case of a thin material such as the hoop mentioned above, pitting corrosion causes great deterioration in fatigue strength.

Many such halogens are the chlorine of NaCl. Fine NaCl particles which come from the sea or the human body are present in ordinary environments. FIG. 1 is a SEM photograph showing an example of a particle attached to a steel in an ordinary work environment. This was analyzed by an EDX (Energy Dispersive X-ray Analyzer), and it turned out to be NaCl. Such fine NaCl particles are floating in a production process and an assembling process of parts unless the processes are performed in a clean room. Furthermore, in the case in which fine defects or fine particles are on the surface of the parts, water vapor in the air may easily condense at the points by capillary action (see "Examples of corrosion and kinds of measures to corrosion of metal", p. 186, published by TECHNOSYSTEM). NaCl particles and water vapor floating in air are contacted on the surface of steel, generating drops of aqueous NaCl, and pitting corrosion may occur by the reaction shown in FIG. 2. In this way, surface pitting corrosion may occur without being in a special corrosion environment, and this pitting corrosion causes great deterioration in fatigue strength.

Conventionally, to prevent pitting corrosion, environmental measures or a method to improve pitting corrosion resistance of a steel itself has been performed. As the environmental measures, contact with water vapor or halogens is prevented. These measures can be performed when parts are produced and assembled in a clean room, although it is difficult to perform in all processes, and it is almost impossible to perform completely. Therefore, pitting corrosion resistance of steel itself is required to be improved.

To improve pitting corrosion resistance, it is effective to passivate the surface. Passivation of the surface by an alloy element control or other passivation treatment of the surface can be performed as the method. In particular, it is extremely efficient to add, for example, Cr as the alloy element control. However, in the case of a steel in which Cr cannot be added, for example, in the case of maraging steel, addition of Cr causes deterioration of strength characteristics. As a surface passivating treatment, a treatment in which steel is immersed in, for example, dichromate solution or nitrite solution, can be performed. However, immersing and drying processes are then required. Furthermore, it is difficult to perform uniform passivation unless the drying process is devised, and there is a case in which the steel becomes rusty.

It is known that thin passivated layer having a thickness of not more than 10 nm and containing FeOOH, $Fe_3O_4$, or $Fe_2O_3$ is formed on the surface of the iron (see "Corrosion and Corrosionproofing Handbook", 2000, p. 23, published by MARUZEN). An important fact about pitting corrosion resistance is to form passivated layer as uniformly as possible. Partial passivated layer and partial oxide layer cause forming of a local battery and the pitting corrosion resistance may be deteriorated.

SUMMARY OF THE INVENTION

Therefore, an object of the present invention is to provide a process for production of nitrided steel in which a uniform passivated layer can be reliably formed by a simple method, and therefore, fatigue strength can be improved together with improvement of pitting corrosion resistance.

The inventors discovered that the surface of maraging steel is activated after nitriding, and that a uniform passivated layer can be formed on the surface by immersion in an oxidizing atmosphere, and thus the present invention was completed. That is, the present invention has a property that after steel is nitrided, passivation treatment in which the steel is heated in an atmosphere containing oxygen is performed.

In the present invention, only by a relatively simple process in which heating is performed in an atmosphere containing oxygen after nitriding, the surface of the steel is passivated to form a passivated layer which improves pitting corrosion resistance. Therefore, a conventional process which requires complicated control such as addition of an element to promote passivation or immersion in passivation treatment solution is no longer required, and the passivated layer can be easily formed.

In the present invention, the surface is oxidized by heating after the steel is nitrided. In the case in which extent of oxidizing by heating is insufficient, only a partial passivated layer is formed, and pitting corrosion occurs on an activated part which is not passivated. On the other hand, in the case in which the extent is too strong, an oxide layer containing mainly $Fe_2O_3$ is formed, local battery is formed between this oxide layer and the passivated layer, deteriorating pitting corrosion resistance. Therefore, optimum heating conditions (oxidizing conditions) as a passivating treatment after nitriding were researched, and it became clear that desirable passivated layer can be formed if the heating conditions are within a range of an area surrounded by coordinates of temperature and time (100° C., 120 min), (100° C., 10 min), (125° C., 5 min), (190° C., 5 min), (200° C., 10 min), (200° C., 20 min), (190° C., 30 min), (190° C., 40 min), (180° C., 60 min), and (180° C., 120 min). This range is the desirable aspect of the heating condition of the present invention.

Furthermore, more desirable heating conditions are in a range of area surrounded by coordinates (100° C., 120 min), (100° C., 30 min), (125° C., 20 min), (170° C., 20 min), (170° C., 40 min), (160° C., 60 min), and (160° C., 120 min).

It should be noted that if a nitriding treatment, in which the surface is activated by halogens or $H_2S$ before the nitriding, is performed, the passivating treatment of the present invention is extremely effective since corrosion resistance of the steel having high activity after the nitriding is deteriorated.

The passivating treatment is performed after the nitriding treatment in the present invention, and these series of treatments can be performed in respective heating furnaces, or continuously in the same furnace. FIG. 3 shows an example of the heating conditions of the nitriding treatment. In this case, heating was first performed from an ordinary temperature to 460° C. for 60 minutes in a $N_2$ atmosphere, then heating was performed for 10 minutes in a $NF_3$ atmosphere, then heating was performed for 30 minutes in atmosphere of $NH_3$, $H_2$, and $N_2$, and then, the temperature was lowered to an ordinary temperature over 60 minutes in a $N_2$ atmosphere. After the nitriding treatment, the passivating treatment was performed in another furnace. FIG. 4 shows an example of heating conditions of such passivating treatment. In this case, heating is performed from ordinary temperature to a set temperature (T° C.) over 5 minutes in the air, heating is performed for a set time (x minutes) in the air, and then, the temperature is lowered to an ordinary temperature over 5 minutes in the air.

On the other hand, in the case in which nitriding treatment and passivating treatment are continuously performed in the same furnace, as is shown in FIG. 5, heating was first performed from ordinary temperature to 460° C. over 60 minutes in a $N_2$ atmosphere, then heating was performed for 10 minutes in $NF_3$ atmosphere, then heating was performed for 30 minutes in an atmosphere of $NH_3$, $H_2$, and $N_2$, and then, the temperature was lowered to a set temperature (T° C.) of the passivating treatment for 60 minutes in a $N_2$ atmosphere, to complete the nitriding treatment. The atmosphere of the furnace is continuously replaced by air to prepare for the passivating treatment, the set temperature (T° C.) is maintained for a set time (x minutes), and then, the temperature is lowered to an ordinary temperature for 10 minutes in the air.

FIG. 6 is a modified example of the heating conditions shown in FIG. 5. In this case, passivating was performed while the temperature was slowly decreased from 150° C. to 100° C. The passivating can be performed in this condition. Furthermore, as is shown in FIG. 7, the passivating can be similarly performed while slowly decreasing the temperature, even in the case in which the nitriding and the passivating are performed independently in respective furnaces.

In addition to the passivating of the present invention, higher pitting corrosion resistance can be obtained by reducing humidity to prevent water from attaching, or by coating oil on the surface of steel during production thereof.

BEST MODE FOR CARRYING OUT THE INVENTION

Desirable Examples of the present invention are explained as follows.

(1) Heating Conditions in Passivating Treatment

Figure 1:
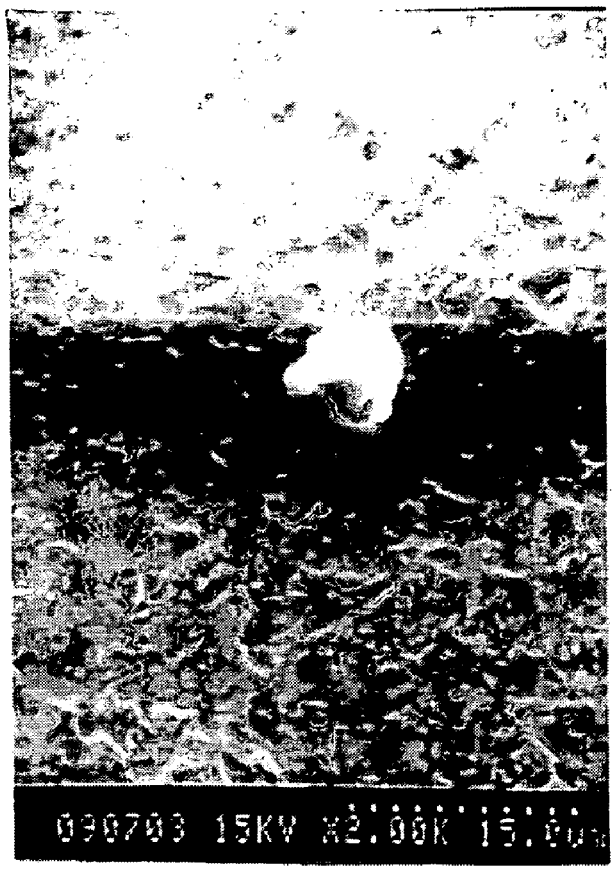
FIG. 1 is an SEM photograph showing a NaCl particle attached on steel.
Figure 2:
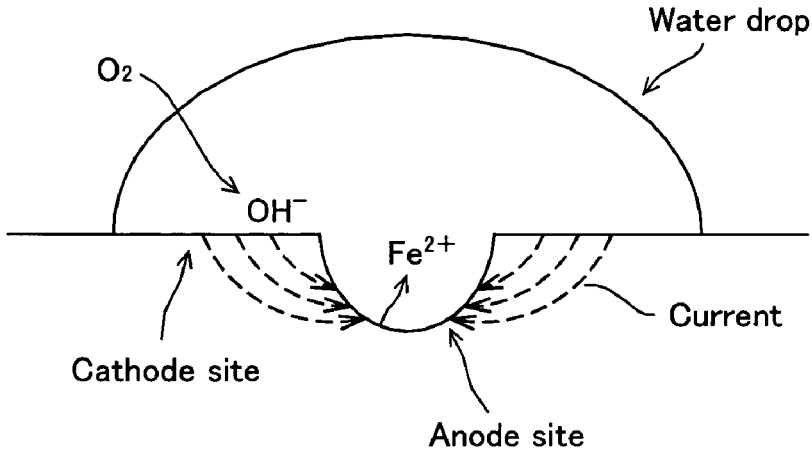
FIG. 2 is a drawing showing a mechanism of pitting corrosion generated by a reaction of a NaCl particle and water vapor.
Figure 3:
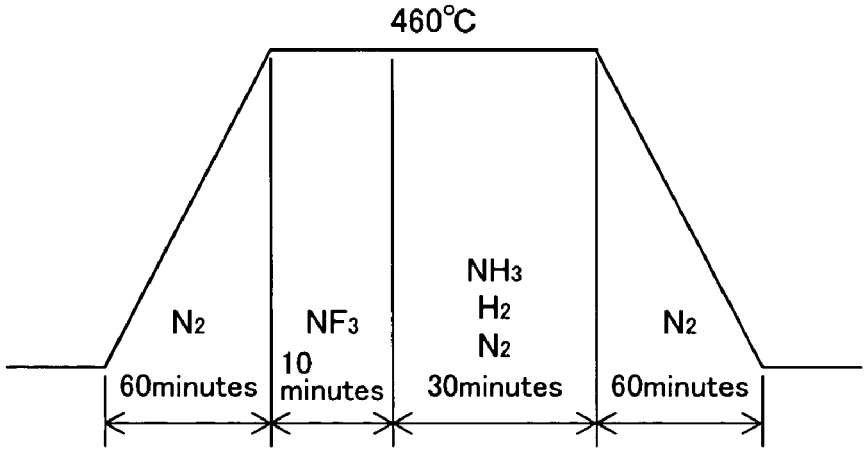
FIG. 3 is a graph showing an example of a heating condition of the nitriding treatment of the present invention.
Figure 4:
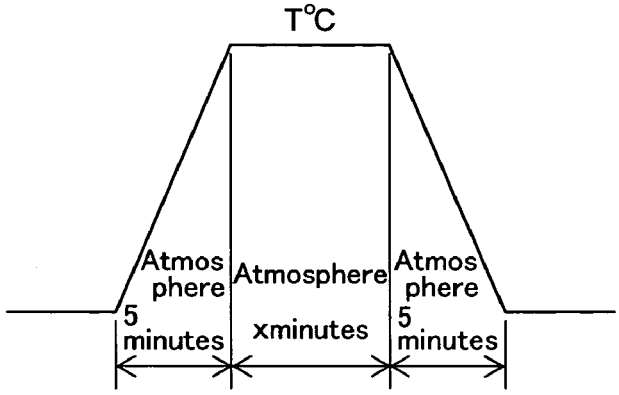
FIG. 4 is a graph showing an example of a heating condition of the passivating treatment of the present invention.
Figure 5:
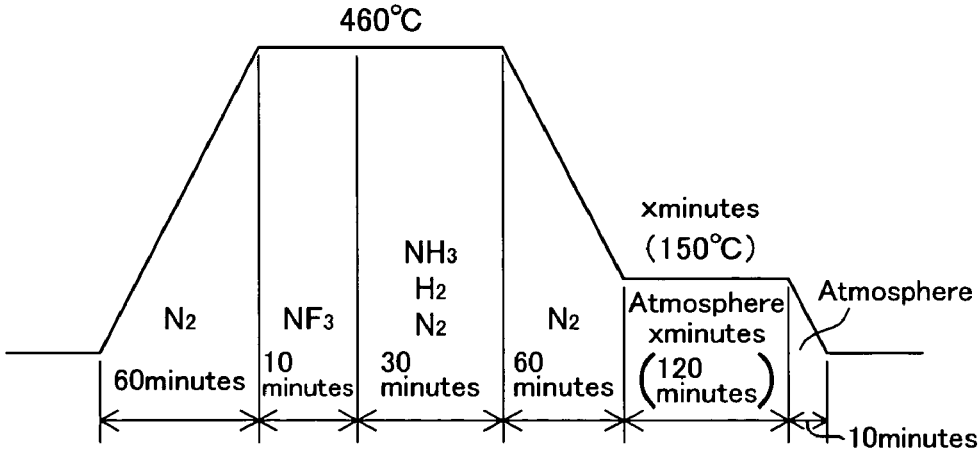
FIG. 5 is a graph showing an example of a heating condition of the process in which the nitriding and passivating are continuously performed in the present invention.
Figure 6:
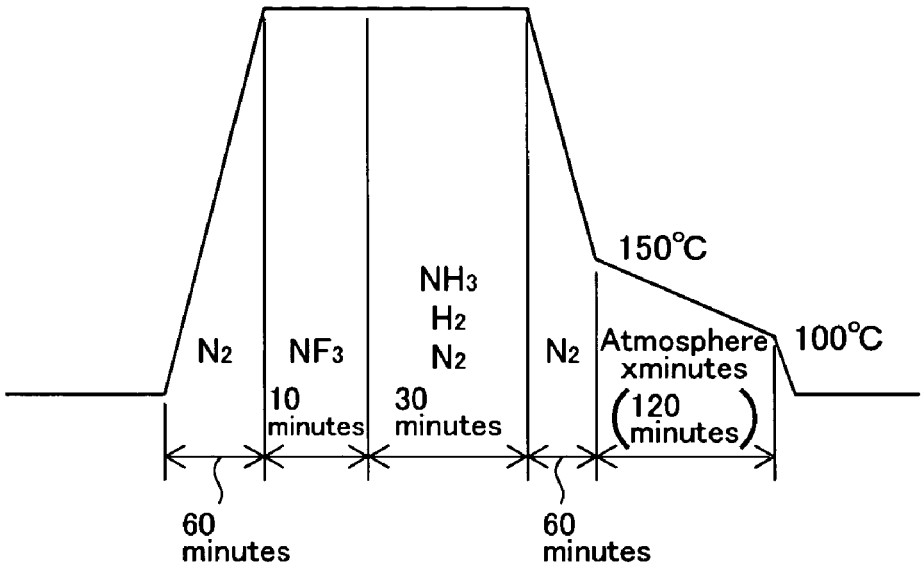
FIG. 6 is a graph showing a modified example of a heating condition of the treatment in which the nitriding and passivating are continuously performed in the present invention.
Figure 7:
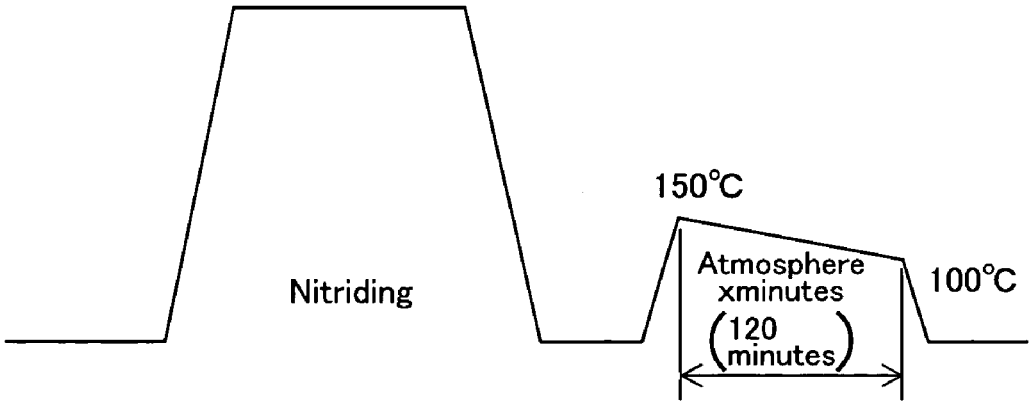
FIG. 7 is a graph showing another modified example of a heating condition of the treatment in which the nitriding and passivating are continuously performed in the present invention.
Figure 8:
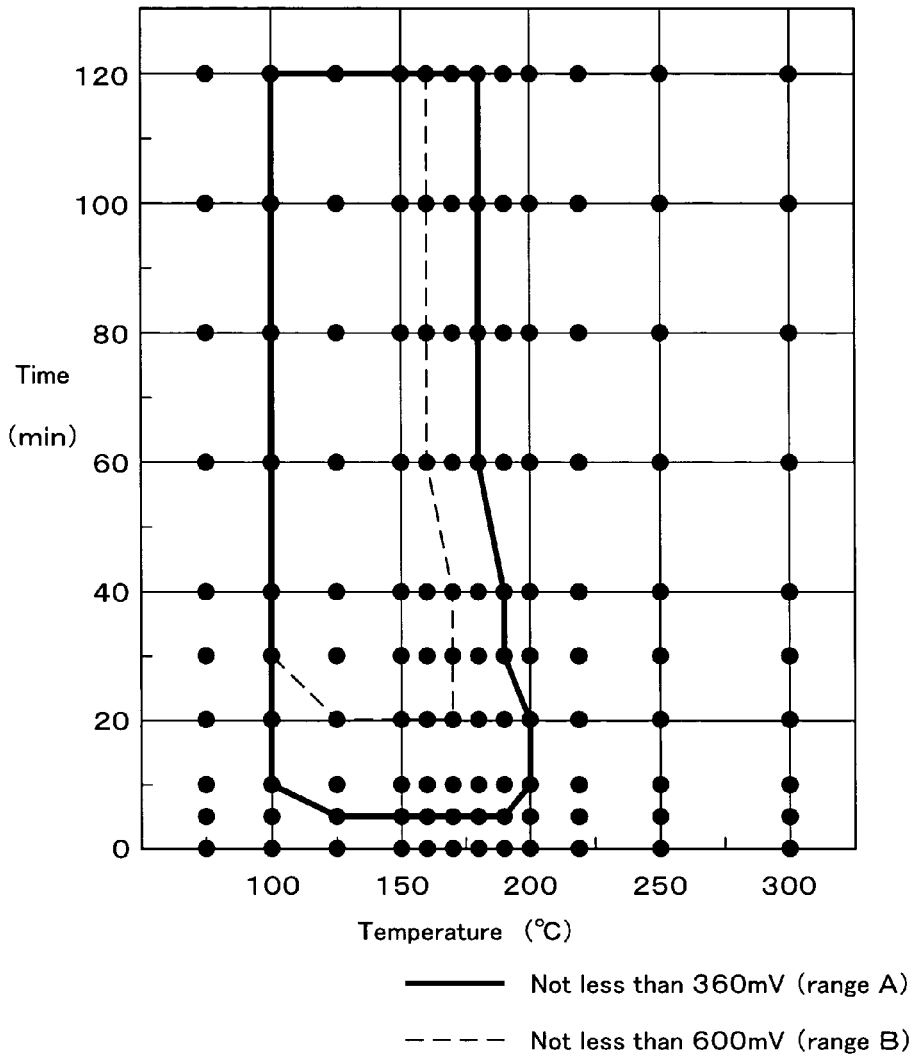
FIG. 8 is a drawing showing a combination of temperature and time which are the heating conditions of the passivating treatment of the present invention by coordinate axes.

A number of test pieces were cut from maraging steel having a composition in which elements except Fe and inevitable elements shown in Table 1 are contained. These test pieces were nitrided, and passivating treatment was performed in the air with varying heating condition which is a combination of heating temperature and time to obtain nitrided steel of Examples. The heating condition of FIG. 3 was applied to the nitriding treatment and the heating condition of FIG. 4 was applied to the passivating treatment. Set temperatures and set times are shown in Table 2. On the other hand, the Comparative Examples were obtained in which only the above-mentioned nitriding treatment was performed and the passivating treatment was not performed. The Comparative Examples are shown in a field of treating time 0 min in Table 2. FIG. 8 is a drawing showing a combination of temperature and time which are the heating condition, in coordinate axes. Points corresponding to the heating conditions of the Examples and the Comparative Examples are plotted with black points.

TABLE 1

| C | Si | Mn | P | S | Ni | Mo | Co | Al | Ti |
|---|---|---|---|---|---|---|---|---|---|
| ≦ 0.01 | ≦ 0.05 | ≦ 0.05 | ≦ 0.008 | ≦ 0.004 | 15 to 19 | 3 to 5.5 | 8 to 15 | 0.05 to 0.15 | 0.4 to 1.5 |

(wt %)

TABLE 2

| Temperature (° C.) | Treating time (min) | | | | | | | | | |
|---|---|---|---|---|---|---|---|---|---|---|
| | 0 | 5 | 10 | 20 | 30 | 40 | 60 | 80 | 100 | 120 |
| 75 | 145 | 130 | 172 | 119 | 180 | 178 | 165 | 201 | 189 | 220 |
| 100 | 145 | 306 | 372 | 372 | 626 | 721 | 721 | 788 | 790 | 802 |
| 125 | 145 | 410 | 561 | 650 | 670 | 770 | 770 | 798 | 745 | 820 |
| 150 | 145 | 416 | 587 | 621 | 660 | 760 | 720 | 801 | 788 | 801 |
| 160 | 145 | 385 | 498 | 612 | 620 | 635 | 702 | 712 | 677 | 621 |
| 170 | 145 | 412 | 514 | 618 | 614 | 618 | 527 | 489 | 498 | 510 |
| 180 | 145 | 420 | 509 | 509 | 480 | 465 | 420 | 361 | 390 | 381 |
| 190 | 145 | 381 | 412 | 456 | 413 | 382 | 357 | 212 | 195 | 153 |
| 200 | 145 | 234 | 420 | 420 | 320 | 281 | 170 | 133 | 101 | 67 |
| 220 | 145 | 167 | 179 | 180 | 211 | 129 | 129 | 102 | 89 | 75 |
| 250 | 145 | 135 | 160 | 121 | 100 | 52 | 52 | 5 | | |
| 300 | 145 | 98 | 111 | 62 | 4 | -28 | -45 | | | |

(mV vs. SCE)

(2) Measurement of Pitting Potential

Figure 9:
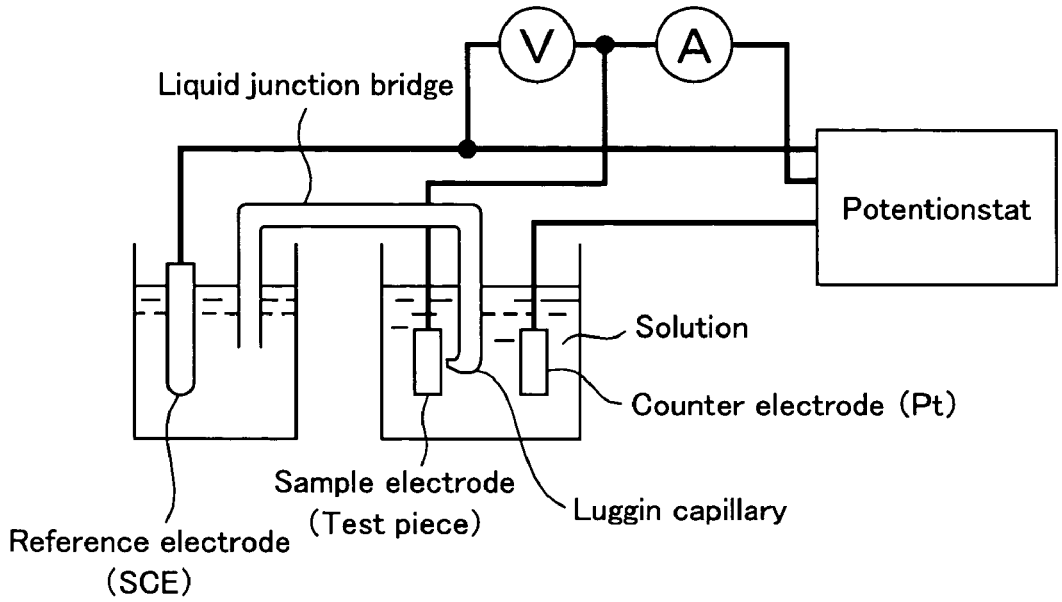
FIG. 9 is a schematic diagram showing a construction of an anodic polarization test device to measure pitting potential of the Examples of the present invention.
Figure 10:
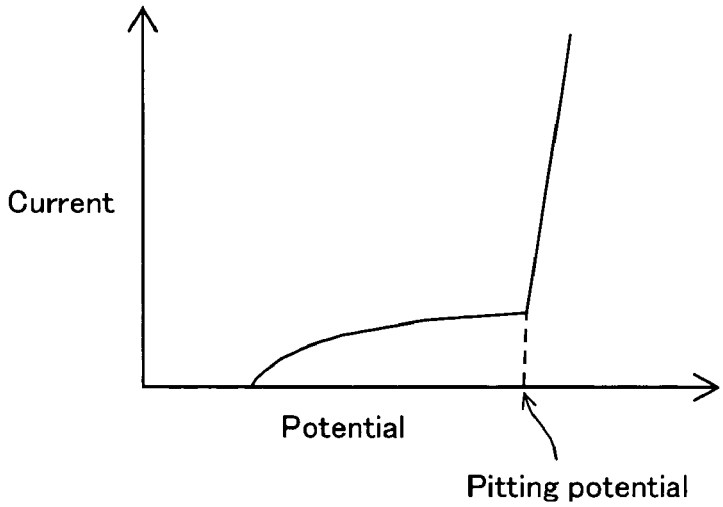
FIG. 10 is a graph showing an example of an anodic polarization curve.

The test pieces of the Examples and the Comparative Examples were immersed into solution of 0.1 N—NaCl+0.5 N—$Na_2SO_4$, an anodic polarization test was performed by a potential scanning method at 25° C. The testing device is shown in FIG. 9. SCE (saturated calomel electrode) was used as a reference electrode (hereinafter, potential is shown in SCE standard). NaCl was added as a type of halogen to generate pitting corrosion, and $Na_2SO_4$ was added to provide electric conductivity. As is shown in FIG. 10, the anodic polarization curve shows sudden increase of current depending on increase of potential, and this sudden increase of current is regarded as the pitting potential (mV vs. SCE). The results are shown in Table 2. High pitting corrosion resistance is exhibited as this pitting potential is high. It should be noted that in the case in which conventional passivating treatment immersing in 0.05% of sodium nitrite solution for 10 minutes after nitriding process was performed, the pitting potential was 360 mV vs. SCE.

As is clear from Table 2, a pitting potential similar to or greater than a pitting potential (360 mV vs. SCE) of a steel in which conventional passivating treatment is performed is shown within a range of the heating condition surrounded by the bold solid line, that is, the range surrounded by (100° C., 120 min), (100° C., 10 min), (125° C., 5 min), (190° C., 5 min), (200° C., 10 min), (200° C., 20 min), (190° C., 30 min), (190° C., 40 min), (180° C., 60 min), and (180° C., 120 min). This range (hereinafter referred to as a range A) of the heating condition is shown in FIG. 8 surrounded by the bold solid line. As is explained above, in the case in which the heating condition is within the range A, a pitting potential which can exhibit high pitting corrosion resistance can be obtained. Therefore, a uniform passivated layer is formed on the surface of the steel. Furthermore, in Table 2 and FIG. 8, pitting potential not less than 600 mV vs. SCE is exhibited within a range B surrounded by (100° C., 120 min), (100° C., 30 min), (125° C., 20 min), (170° C., 20 min), (170° C., 40 min), (160° C., 60 min), and (160° C., 120 min). It is clear that higher pitting corrosion resistance can be obtained by the passivating treatment of the heating condition within the range B.

(3) Types of Passivated Layers

Figure 11:
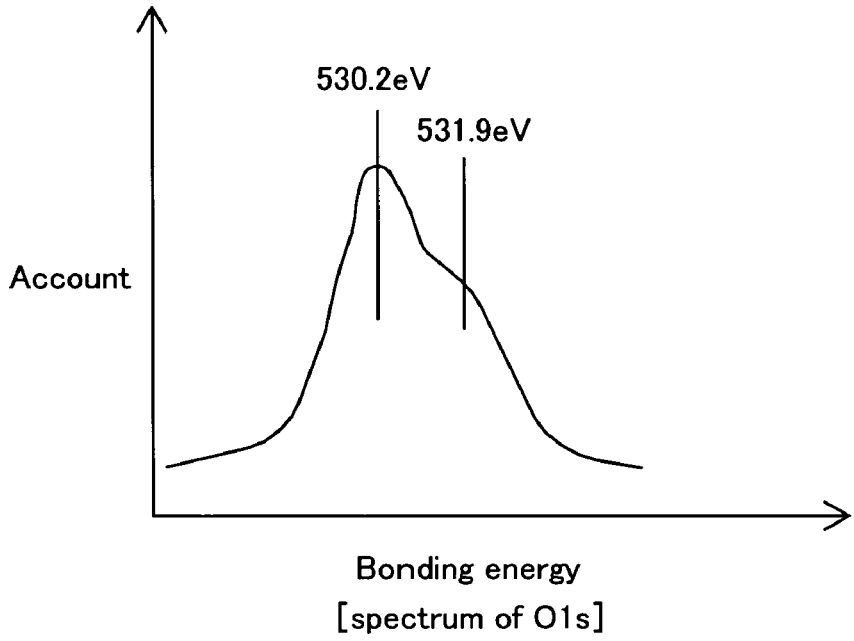
FIG. 11 is a graph showing an O1s spectrum detecting a component of the passivated layer of one of the Example of the present invention.
Figure 12:
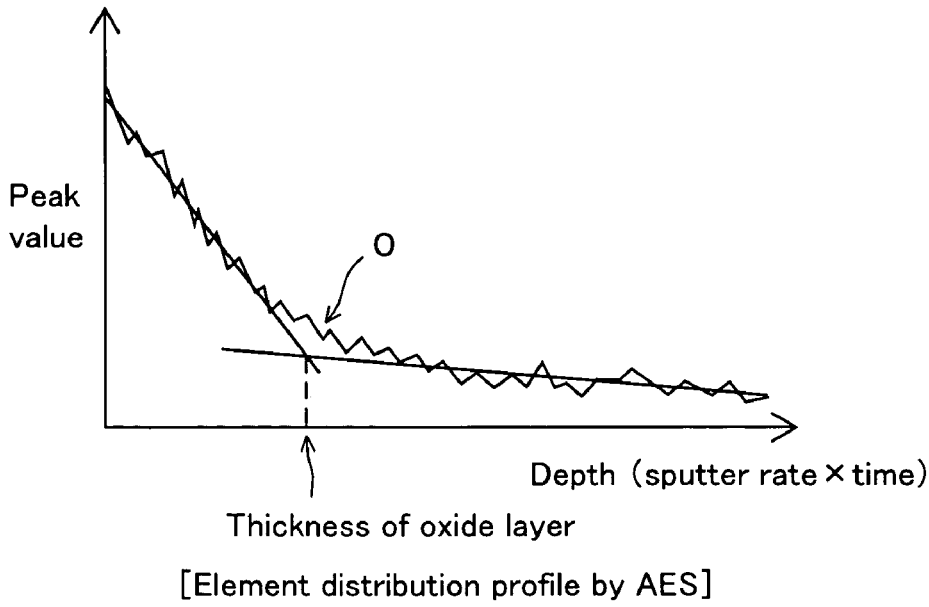
FIG. 12 is a graph showing element distribution profile by AES to measure the thickness of the passivated layer.

One test piece was selected from the test pieces of the Examples in which passivating treatment was performed in the range A, and the surface was analyzed by ESCA (electron spectroscopy for chemical analysis). A spectrum around O1s is shown in FIG. 11. This spectrum has a peak of 530.2 eV originated from M-O bonding and a peak of 531.9 eV originated from M-OH bonding. Therefore, it is clear that FeOOH which is the passivated layer was generated on the steel of Example.

(4) Thickness of Passivated Layers

Some test pieces which were treated in the heating condition shown in Table 3 were selected from the test pieces of the Examples which were passivated in the range A, and the thicknesses of these pieces and thickness of test piece of the Comparative Example which was not passivated were measured. The thicknesses of the passivated layer was measured by observing a distribution condition of oxygen along a depth direction by AES (auger electron spectroscopy) used together with sputtering, and then by calculating intersection of a sudden initial falling line of peak values which are reduced depending on the depth and a stable line in which the rate of reduction is gently sloping. The results are shown in Table 3. As is clear from Table 3, in the case in which the thickness of the passivated layer is not less than 7 nm, the pitting potential is not less than 360 mV vs. SCE.

TABLE 3

| | Passivating conditions | | Thickness | |
|---|---|---|---|---|
| | Temperature (° C.) | Time (min) | of layer (nm) | Pitting potential (mV vs. SCE) |
| Examples | 150 | 5 | 7.0 | 416 |
| | 150 | 10 | 7.7 | 587 |
| | 150 | 30 | 8.8 | 660 |
| | 150 | 60 | 9.5 | 720 |
| | 150 | 120 | 10.2 | 801 |
| | 100 | 5 | 5.4 | 306 |
| | 300 | 10 | 130 | 111 |
| Comparative Example | None | | 3.9 | 145 |

(5) Hoop Fatigue Test

Figure 13:
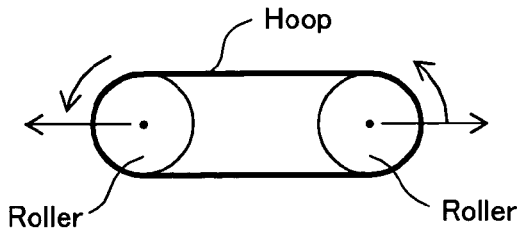
FIG. 13 is a drawing showing a method of fatigue test of a hoop of the example of the present invention.

Hoops having dimensions of thickness 0.18 mm, width 9 mm, and circumference 600 mm were prepared by using maraging steel having compositions in which elements except Fe and inevitable elements shown in Table 1 are contained. These hoops were nitrided by the method shown in FIG. 3, and then passivated by the method shown in FIG. 4 while applying heating conditions shown in Table 4, to obtain Example hoops of Examples. On the other hand, Comparative Example hoops of in which only the nitriding treatment was performed similarly and the passivating treatment was not performed were prepared. Hoops of Examples and Comparative Examples were immersed in 0.02% NaCl solution corresponding to a corrosive environment for 10 minutes and a hoop which was not immersed were prepared. Fatigue tests were performed on these hoops. In Table 4, data of pitting potential shown in Table 2 are also shown. A method of the fatigue test is shown in FIG. 13. A hoop was rolled around two rollers (diameter: 55 mm), and the rollers were rotated while tension of 1700 N was stressed to the hoop until the hoop was broken, to measure fatigue life. The number of times in which the hoop was bent by the roller, that is, two times the rotational frequency was regarded as the value of fatigue life.

TABLE 4

| | Passivating conditions | | Pitting potential | | |
|---|---|---|---|---|---|
| | Temperature (° C.) | Time (min) | (mV vs. SCE) | Immersion to NaCl | Fatigue strength |
| Examples | 150 | 5 | 416 | None | $1.00 \times 10^8$ |
| | 150 | 10 | 587 | None | $1.00 \times 10^8$ |
| | 150 | 5 | 416 | Immersed | $1.00 \times 10^8$ |
| | 150 | 10 | 587 | Immersed | $1.00 \times 10^8$ |
| | 190 | 60 | 357 | None | $1.00 \times 10^8$ |
| | 75 | 10 | 172 | None | $1.00 \times 10^8$ |
| | 190 | 60 | 357 | Immersed | $2.50 \times 10^5$ |
| | 75 | 10 | 172 | Immersed | $8.70 \times 10^4$ |
| Comparative Examples | None | | 145 | None | $1.00 \times 10^8$ |
| | None | | 145 | Immersed | $5.60 \times 10^4$ |

Figure 14:
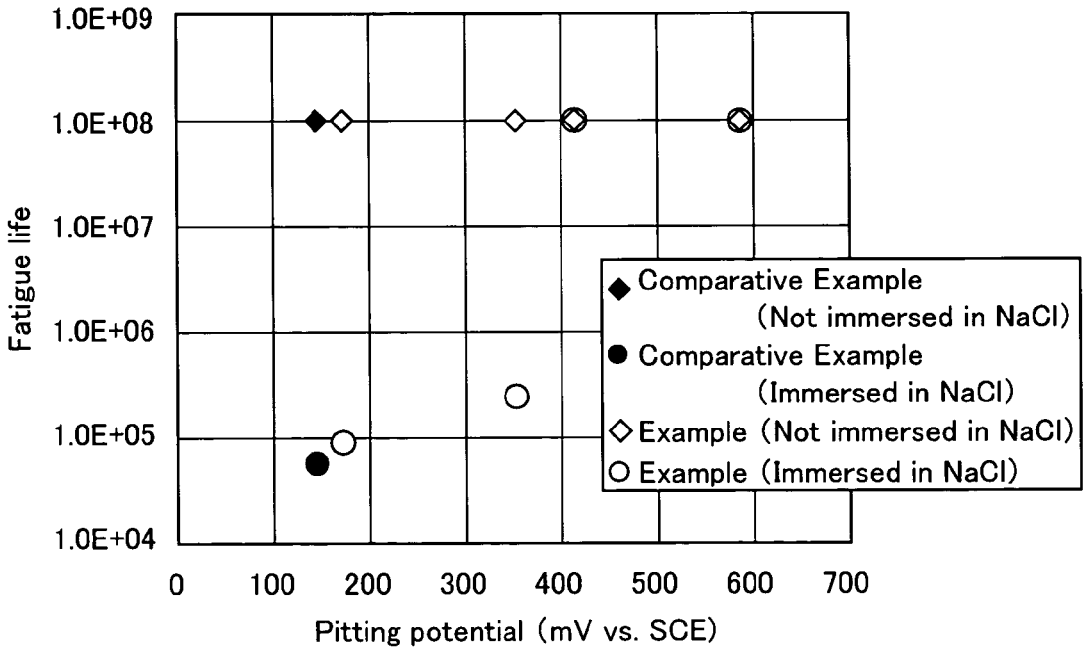
FIG. 14 is a drawing showing a result of the fatigue test of the hoop of the Examples of the present invention.
Figure 15:
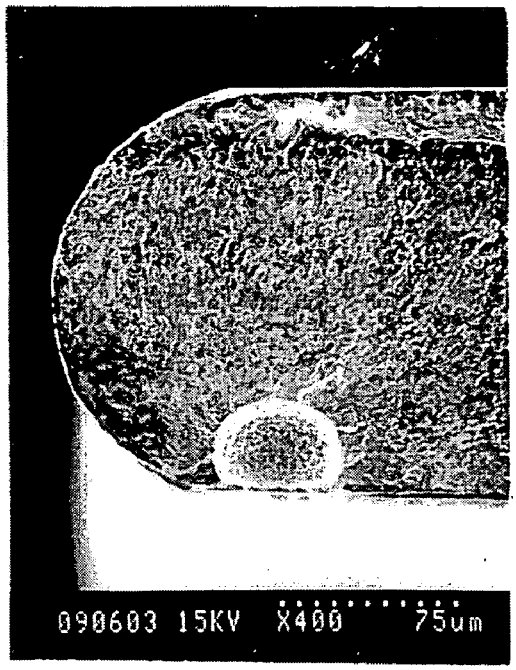
FIG. 15 is a SEM photograph showing a cross section of a hoop of the Comparative Example.

The results of the fatigue tests are shown in Table 4, and the relationship of the results of the fatigue tests and the pitting potential is shown in FIG. 14. In these results, $1.00\times10^8$ of the fatigue life means that the hoop was not broken when the number of times it was bent was $1.00\times10^8$, and the hoop can be bent more than $1.00\times10^8$ times. As is obvious from the results, the hoop of Example has extremely higher fatigue strength than that of the Comparative Examples, and can maintain high pitting corrosion resistance even if exposed to a corrosive environment. FIG. 15 is a SEM photograph of a broken section of the hoop of a Comparative Example, and pitting corrosion which is an origin of fatigue failure obviously exists.

What is claimed is:

1. A process for production of nitrided steel, the process comprising:

a first step of nitriding a maraging steel; and a second step, performed after the first step, of heating the nitrided maraging steel in an atmosphere containing oxygen to passivate the steel, wherein in the second step, only a passivated layer of FeOOH is formed.

2. A process for production of nitrided steel according to claim 1, wherein the passivating is performed in a heating condition within a range surrounded by (100° C., 120 min), (100° C., 10 min), (125° C., 5 min), (190° C., 5 min), (200° C., 10 min), (200° C., 20 min), (190° C., 30 min), (190° C., 40 min), (180° C., 60 min), and (180° C., 120 min) on coordinate axes of temperature and time.

3. A process for production of nitrided steel according to claim 1, wherein the passivating is performed in a heating condition within a range surrounded by (100° C., 120 min), (100° C., 30 min), (125° C., 20 min), (170° C., 20 min), (170° C., 40 min), (160° C., 60 min), and (160° C., 120 min) on coordinate axes of temperature and time.

4. A process for production of nitrided steel according to claim 1, wherein prior to the first step, a surface of the maraging steel is activated by halogens.

5. A process for production of nitrided steel according to claim 1, further comprising coating oil on the surface of the maraging steel.

* * * * *